US010350132B1

(12) United States Patent
Chu et al.

(10) Patent No.: US 10,350,132 B1
(45) Date of Patent: Jul. 16, 2019

(54) FOREARM CRUTCH

(71) Applicants: Zooey Chia-Tien Chu, Byron Center, MI (US); Douglas Pan, Tainan (TW)

(72) Inventors: Zooey Chia-Tien Chu, Byron Center, MI (US); Douglas Pan, Tainan (TW)

( * ) Notice: Subject to any disclaimer, the term of this patent is extended or adjusted under 35 U.S.C. 154(b) by 0 days.

(21) Appl. No.: 15/953,576

(22) Filed: Apr. 16, 2018

(51) Int. Cl.
*A61H 3/02* (2006.01)

(52) U.S. Cl.
CPC ..... *A61H 3/02* (2013.01); *A61H 2003/0211* (2013.01); *A61H 2003/0216* (2013.01)

(58) Field of Classification Search
CPC ..... A61H 3/02
USPC ..... 135/71
See application file for complete search history.

(56) References Cited

U.S. PATENT DOCUMENTS 2,817,348 A * 12/1957 Holliday, Jr. ..... A61H 3/02 135/69
3,174,494 A * 3/1965 Maguire, Jr. ..... A61H 3/02 135/68
3,213,869 A * 10/1965 Frank ..... A61H 3/02 135/71
5,038,811 A * 8/1991 Gilmore ..... A61H 3/02 135/71
8,474,470 B2 * 7/2013 Albertyn ..... A61H 3/02 135/69
2008/0072943 A1 * 3/2008 Forster ..... A61H 3/0244 135/71
2011/0232709 A1 9/2011 Zordan et al.

FOREIGN PATENT DOCUMENTS

FR 2922757 A1 * 5/2009 ..... A61H 3/02
GB 2434828 A * 8/2007 ..... A01D 34/90

* cited by examiner

*Primary Examiner* — Noah Chandler Hawk
(74) *Attorney, Agent, or Firm* — Alan D. Kamrath; Mayer & Williams PC

(57) ABSTRACT

A forearm crutch includes a supporting rod, a handle, and a holding device. The supporting rod is adapted to contact with ground. The supporting rod includes an upper end having a holding portion. The handle is mounted below the holding portion and extending forward. The holding device includes two holding plates and two elastic elements. The two holding plates are respectively mounted to two sides of the holding portion. Each of the two elastic elements is coupled between one of the two holding plates and the coupling portion to provide the two clamping plates with a holding force relative to the holding portion for holding a forearm of a user.

9 Claims, 9 Drawing Sheets

B – B 331
33
333
332
341
34
342
112

141
143
142
322
323
3
31
311
313
32
321
14
14

312
13
131
131
31
1
315
314
15
152
15

153
151

A - A

B - B

FOREARM CRUTCH

BACKGROUND OF THE INVENTION

The present invention relates to a forearm crutch and, more particularly, to a forearm crutch including a holding device for stably holding a forearm of a user while providing convenient use.

A forearm crutch generally includes a holding portion to increase the gripping stability. FIG. 9 shows a conventional forearm crutch including a supporting rod 1', a handle 2' mounted to an upper section of the supporting rod 1', and a holding portion 3'. A soft, plastic cap 11' is mounted to a lower end of the supporting rod 1'. The holding portion 3' is mounted on top of the supporting rod 1' and includes left and right holding plates 31' and 32'. A first end of each of the left and right holding plates 31' and 32' is connected to the supporting rod 1'. Second ends of the left and right holding plates 31' and 32' have a spacing 33' therebetween. A receiving groove 34' is defined between the left and right holding plates 31' and 32'. When a user grips the handle 2', a forearm of the user can be received in the receiving groove 34' and can be held by the left and right holding plates 31' and 32' to increase the supporting stability.

However, the left and right holding plates 31' and 32', when deformed, cannot stably hold the forearm, such that the forearm is apt to slip out of the spacing 33'. Furthermore, the supporting elasticity of the plastic cap 11' is not satisfactory, failing to provide use comfort.

U.S. Patent Publication No. 2011/0232709 discloses a crutch for orthopaedic or similar purposes which can be used with the arms to support the body and/or the legs, with this crutch equipped with a semicircular element which in turn presents two wings facing the front part of the crutch according to the usual forms currently in use. The ends of the wings of the semicircular element are attached to a strap with the appropriate shape and length to allow restraint of the forearm on the support part of the semicircular element. However, a user has to couple the strap to the two wings in use, which is inconvenient.

BRIEF SUMMARY OF THE INVENTION

An objective of the present invention is to provide a forearm crutch including a holding device for stably holding a forearm of a user while providing convenient use.

Another objective of the present invention is to provide a forearm crutch providing use comfort.

A further objective of the present invention is to provide a forearm crutch permitting adjustment of an overall length thereof to increase application.

A forearm crutch according to the present invention includes a supporting rod, a handle, and a holding device. The supporting rod is adapted to contact with ground. The supporting rod includes an upper end having a holding portion. The handle is mounted below the holding portion and extending forward. The holding device includes two holding plates and two elastic elements. The two holding plates are respectively mounted to two sides of the holding portion. Each of the two elastic elements is coupled between one of the two holding plates and the coupling portion to provide the two clamping plates with a holding force relative to the holding portion for holding a forearm of a user.

In an example, each of the two sides of the holding portion includes a notch. Each of the two sides of the holding portion further includes an upper pivotal portion protruding into a respective notch and a lower pivotal portion protruding into the respective notch. Each upper pivotal portion has a pivotal hole. Each lower pivotal portion includes an axle extending upward. The holding device further includes two pivots. Each of the two holding plates includes a holding plate body for holding the forearm of the user. Each holding plate body includes a side pivotal portion received in one of the notches. Each side pivotal portion includes an upper end having an insertion groove aligned with the pivotal hole of one of the upper pivotal portions. Each side pivotal portion further includes a lower end having a pivotal hole receiving the axle of one of the upper pivotal portions. Each holding plate body has a front end. The front ends of the holding plate bodies have a spacing therebetween. Each of the two pivots is received in the pivotal hole of one of the upper pivotal portions. Each of the two pivots includes a lower end having an insertion portion received in the insertion groove of one of the two holding plates. Each of the two holding plates is configured to pivot one of the two pivots in the pivotal hole of one of the upper pivotal portions. Each of the two elastic elements is coupled to one of the two pivots and the holding portion of the supporting rod and biases one of the two holding plates to hold the forearm of the user.

In an example, the pivotal hole of each upper pivotal portion of the supporting rod includes an inner periphery having an insertion groove. Each of the two pivots includes an upper end having a coupling portion with a slot. Each of the two elastic elements is a coil spring having a coil portion and first and second tangs. The coil portion of each coil spring is mounted around the coupling portion of one of the two pivots. The first tang and the second tang of each coil spring are respectively mounted to the slot of one of the two pivots and the insertion groove of one of the upper pivotal portions.

In an example, each of the lower pivotal portions of the supporting rod includes a limiting portion having a diameter smaller than the axle thereof. Each limiting portion has a limiting member on an outer periphery thereof. The pivotal hole of the side pivotal portion of each holding plate receives the axle of one of the lower pivotal portions. The pivotal hole of each side pivotal portal portion includes an inner periphery having an upper end with a projection abutting against the limiting member to limit a minimum holding angle of the two holding plates.

In an example, the holding device further includes two caps, and each of the two caps covers the pivotal hole of one of the upper pivotal portions.

In an example, the pivotal hole of each of the upper pivotal portions includes an inner periphery having an engaging protrusion. Each of the two caps includes a lid and a sidewall extending downward. The sidewall of each of the two caps engages with the engaging protrusion to cover the pivotal hole of one of the upper pivotal portions.

In an example, the supporting rod includes an upper section, a lower section, and a positioning knob. The upper section and the lower section are coupled by the positioning knob. The holding portion is disposed on the upper section. The lower section includes a lower end having a supporting portion.

In an example, a lower end of the upper section includes a coupling groove extending in a vertical direction and a lateral wall having a coupling hole in communication with the coupling groove. The lower section includes an upper end having an insertion section with a plurality of coupling holes spaced from each other in a vertical direction. The insertion section is inserted into the coupling groove, and the positioning knob extends through the coupling hole of the upper section and one of the plurality of positioning holes of the lower section to fix a length of the supporting rod.

In an example, the supporting portion includes a rectilinear section connected to a lower end of the insertion section. The supporting portion further includes a lower end with a bend section. The bend section is arcuate and includes a bottom. The bend section further includes an upper inner face and a lower inner face. An upper abutting plate extends outward from the upper inner face. A lower abutting plate extends outward from the lower inner face and is spaced from the upper abutting plate to provide a buffering space for the bend section when compressed.

The present invention will become clearer in light of the following detailed description of illustrative embodiments of this invention described in connection with the drawings.

DESCRIPTION OF THE DRAWINGS

FIG. 2 is an exploded, perspective view of a portion of the forearm crutch.

DETAILED DESCRIPTION OF THE INVENTION

Figure 1:
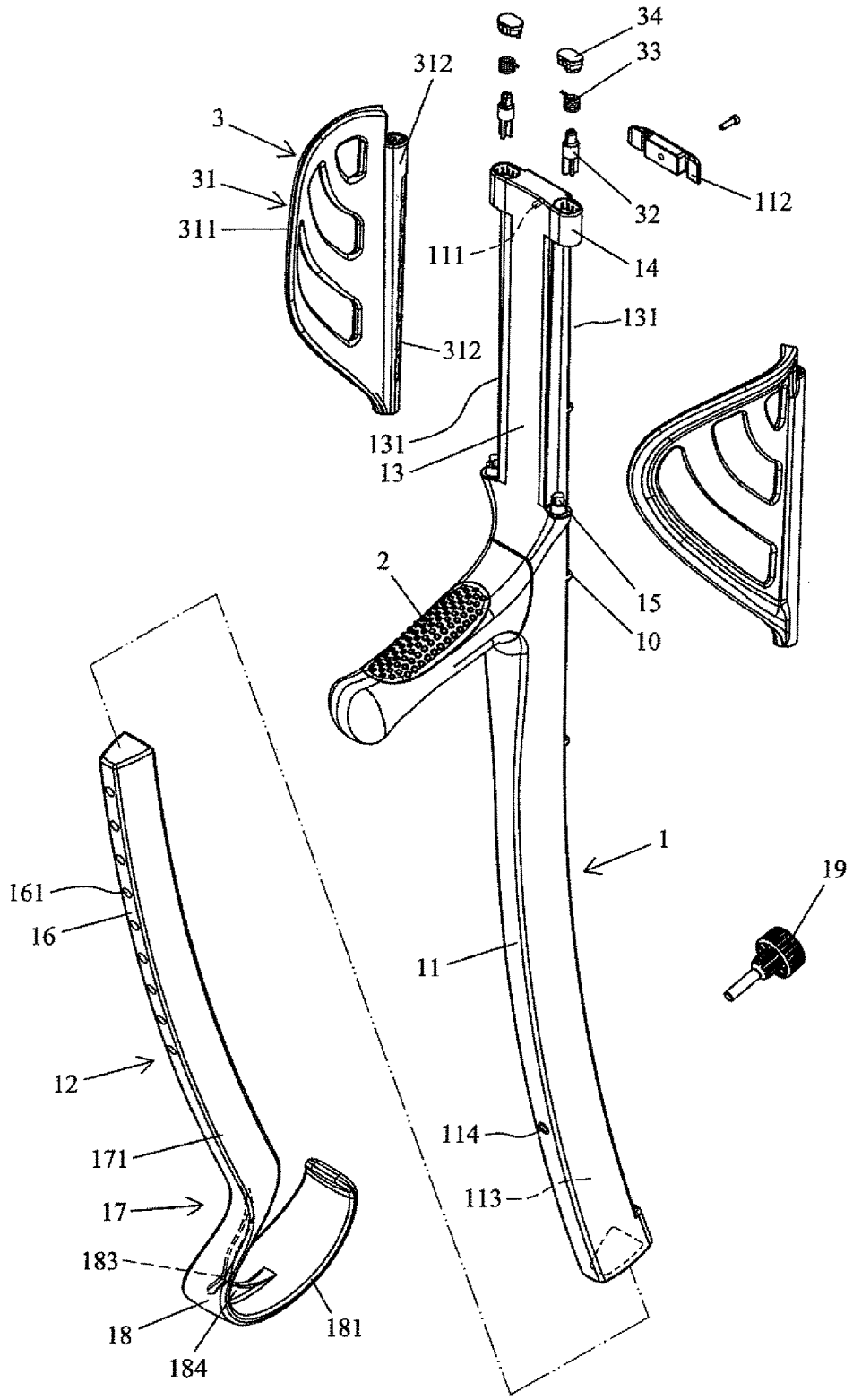
FIG. 1 is an exploded, perspective view of a forearm crutch of an embodiment according to the present invention.
Figures 2A, 2B, 2C, 2D:
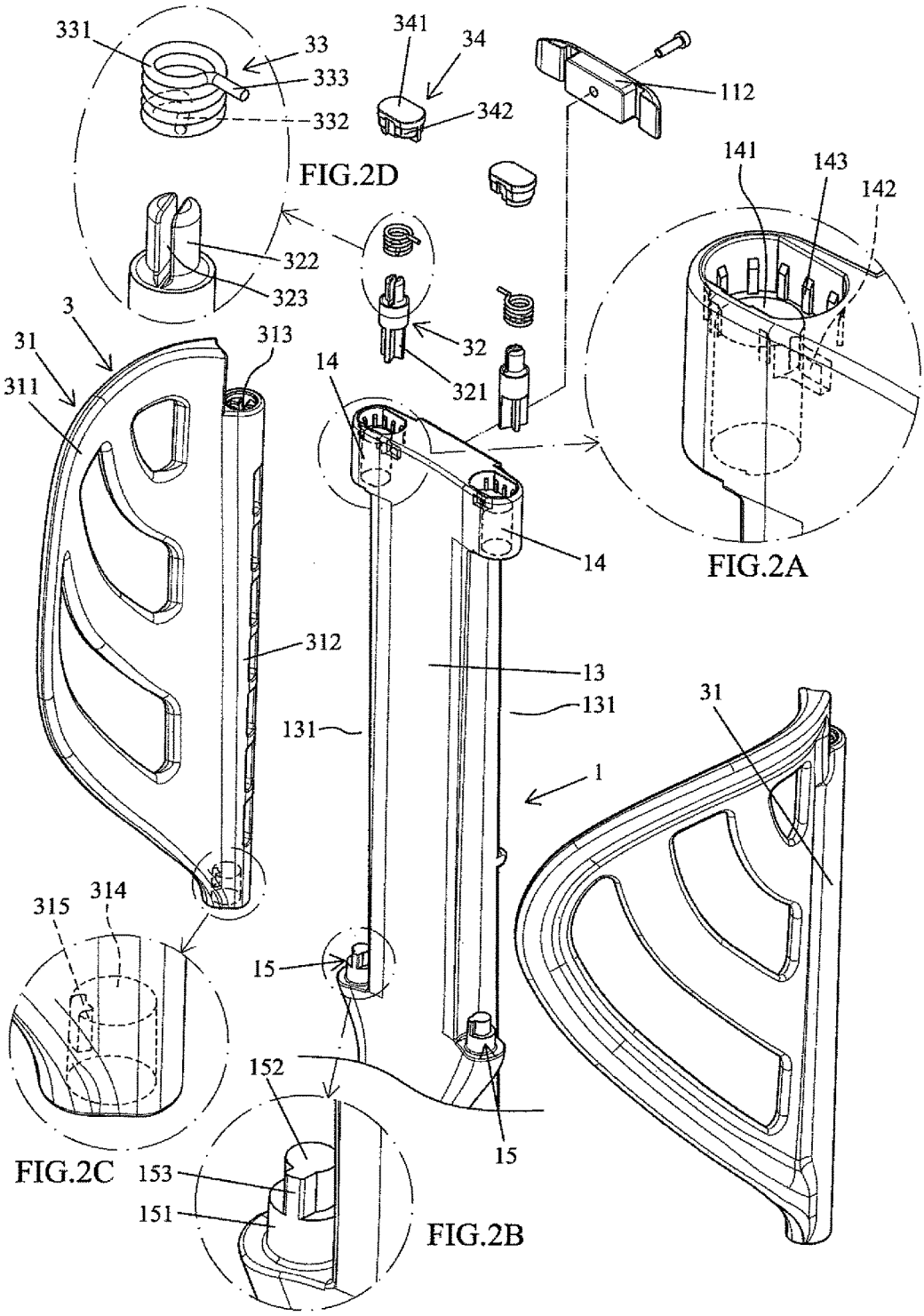
FIG. 2A-2D are enlarged views of circled portions of the forearm crutch of FIG. 2.
Figure 3:
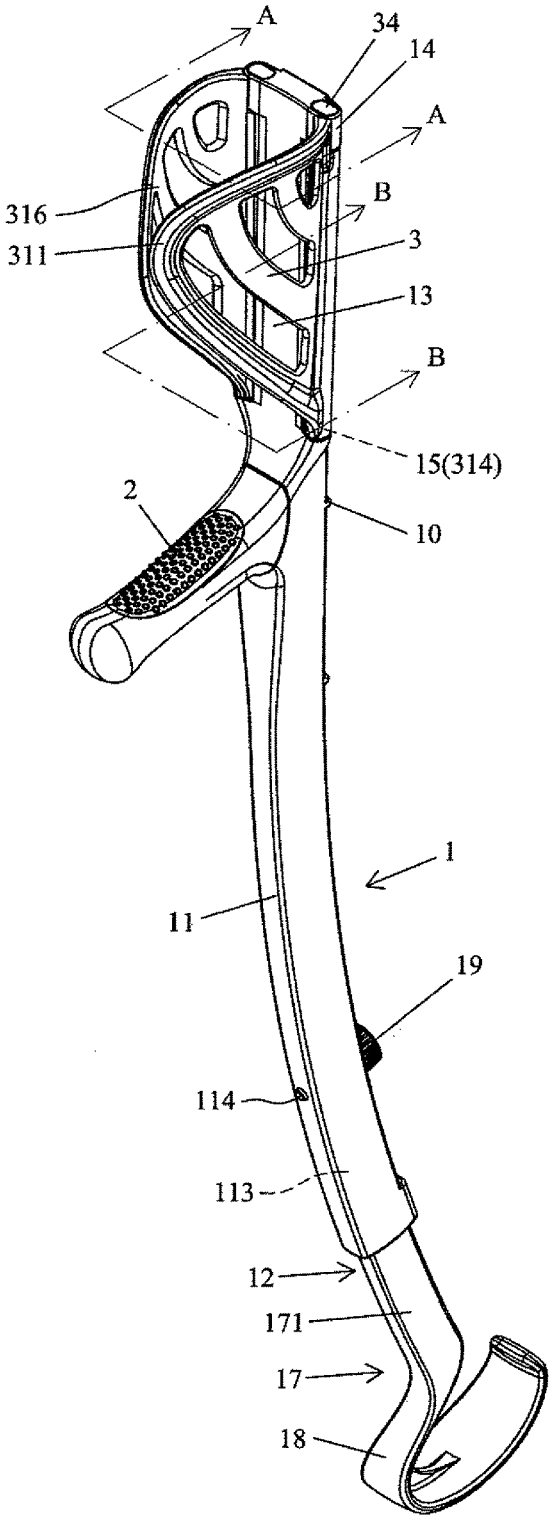
FIG. 3 is a perspective view of the forearm crutch.
Figure 4:
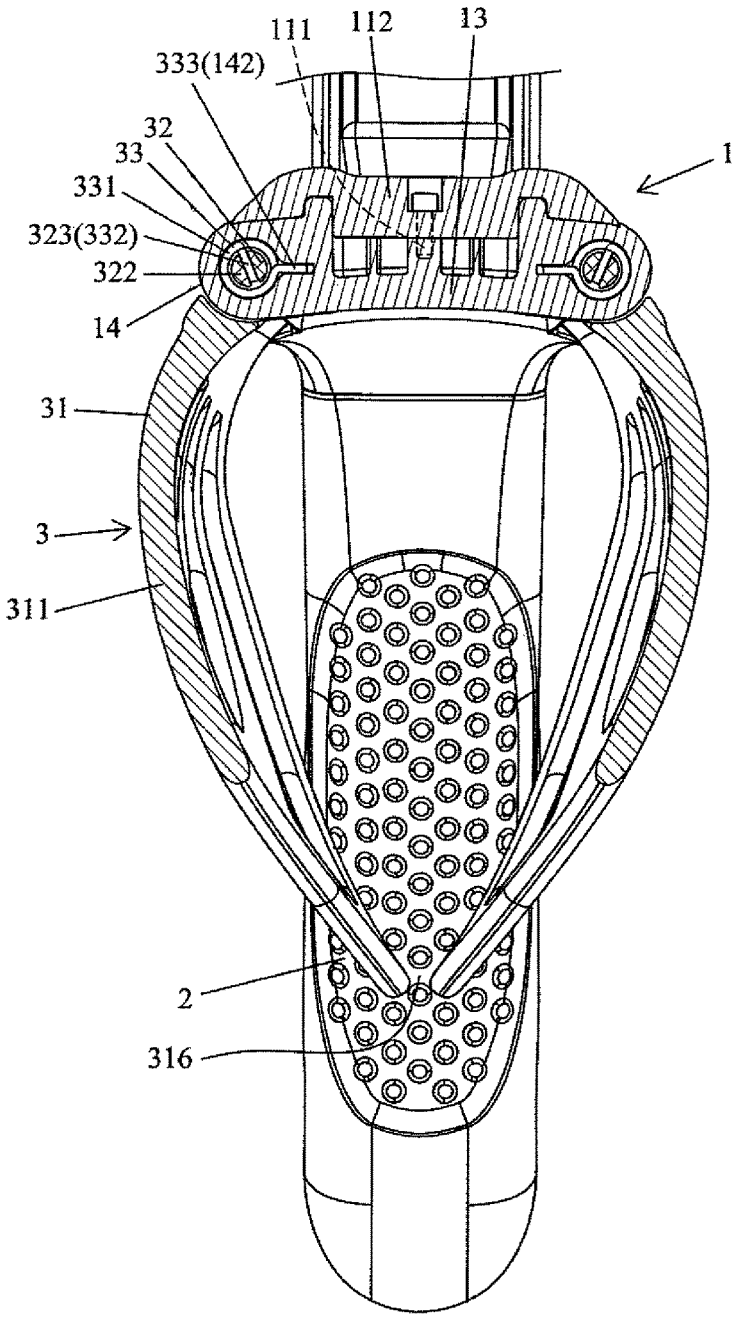
FIG. 4 is a cross sectional view taken along section line A-A of FIG. 3.

With reference to FIGS. 1-5, a forearm crutch according to the present invention includes a supporting rod 1, a handle 2, and a holding device 3. The supporting rod 1 is adapted to contact with ground and includes an upper section 11, a lower section 12, and a positioning knob 19. A holding portion 13 is disposed on the upper section 11 and includes two sides, with each of the two sides having a notch 131. Each of the two sides of the holding portion 13 further includes an upper pivotal portion 14 protruding into a respective notch 131 and a lower pivotal portion 15 protruding into the respective notch 131. Each upper pivotal portion 14 has a pivotal hole 141. Each pivotal hole 141 includes an inner periphery having an insertion groove 142 and at least one engaging protrusion 143. Each lower pivotal portion 15 includes an axle 151 extending upward. Each of the lower pivotal portions 15 of the supporting rod 1 includes a limiting portion 152 having a diameter smaller than the axle 151 thereof. Each limiting portion 152 has a limiting member 153 on an outer periphery thereof. A coupling hole 111 is defined in a rear face of a top of the upper section 11. An anti-slip pad 112 is coupled with the coupling hole 111. When the forearm crutch props against a wall (not shown), the anti-slip pad 112 provides an anti-slip function. A lower end of the upper section 11 includes a coupling groove 113 extending in a vertical direction and a lateral wall having a coupling hole 114 in communication with the coupling groove 113. At least one abutment protrusion 10 is provided on a rear side of the upper section 11. The at least one abutment protrusion 10 can prop against an edge of a table (not shown) to support and position the forearm crutch, preventing falling of the forearm crutch.

Figure 7:
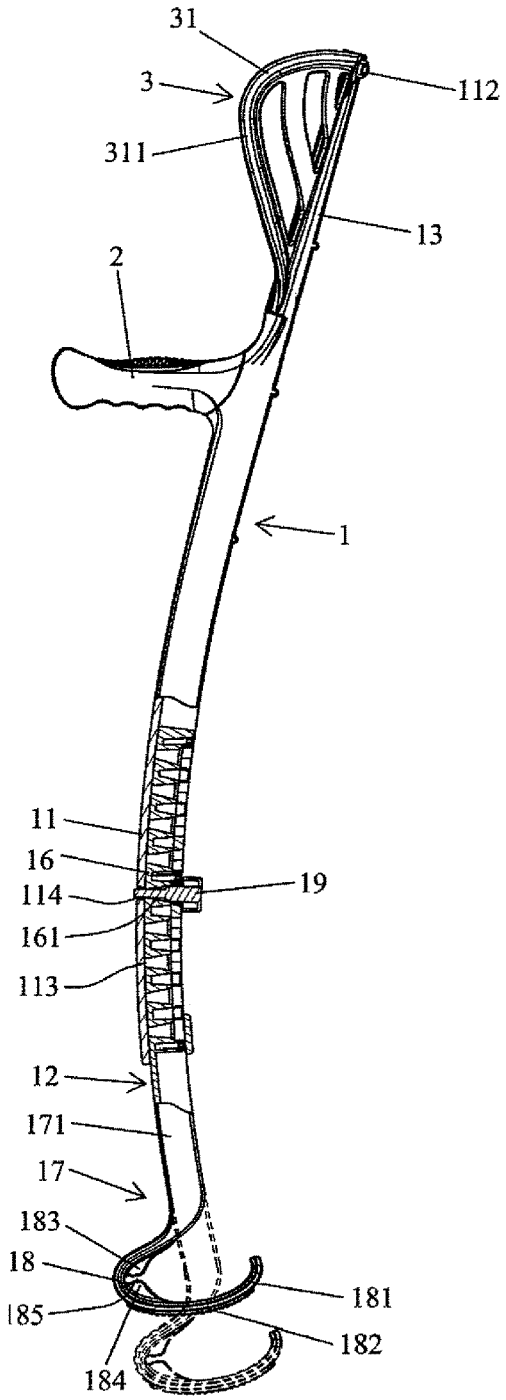
FIG. 7 is a diagrammatic side view, partly cross sectioned, illustrating adjustment of a length of a supporting rod of the forearm crutch.
Figures 8, 8A:
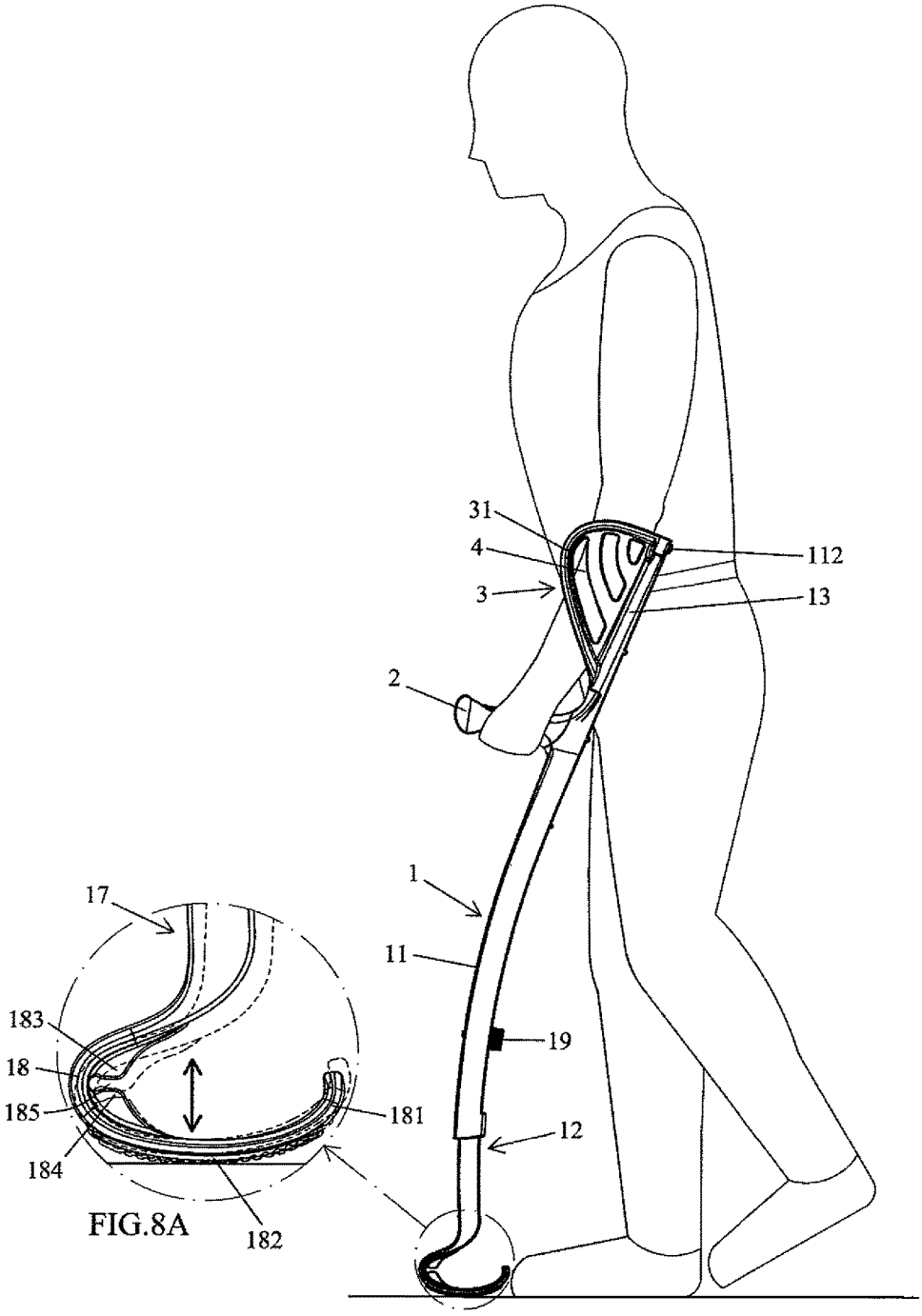
FIG. 8 is a diagrammatic view illustrating use of the forearm crutch.
FIG. 8A is an enlarged view of a circled portion of the forearm crutch of FIG. 8.
Figure 9:
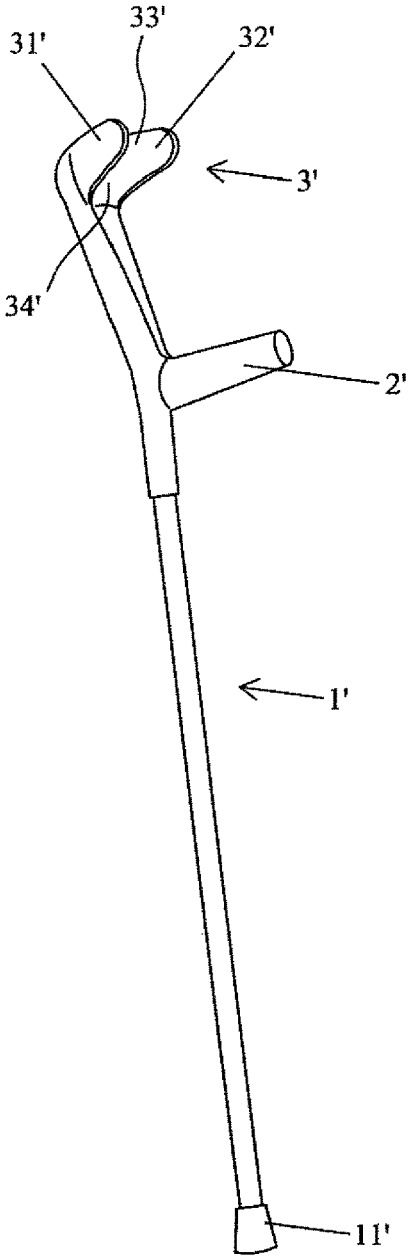
PRIOR ART F I G . 9
FIG. 9 is perspective view of a conventional forearm crutch.

The lower section 12 includes an upper end having an insertion section 16 with a plurality of coupling holes 161 spaced from each other in a vertical direction. The insertion section 16 is inserted into the coupling groove 113 to a desired depth of the coupling groove 113. The positioning knob 19 extends through the coupling hole 114 of the upper section 11 and one of the plurality of coupling holes 161 of the lower section 12 to fix a length of the supporting rod 1. The lower section 12 further includes a lower end having a supporting portion 17. The supporting portion 17 includes a rectilinear section 171 connected to a lower end of the insertion section 16. The supporting portion 17 further includes a lower end with a bend section 18. The bend section 18 is arcuate and includes a bottom 181. An anti-slip pad 182 is mounted to the bottom 181 (FIGS. 7, 8 and 8A). The bend section 18 further includes an upper inner face and a lower inner face. An upper abutting plate 183 extends outward from the upper inner face. A lower abutting plate 184 extends outward from the lower inner face and is spaced from the upper abutting plate 183 to provide a buffering space 185 for the bend section 18 when compressed.

The handle 2 is mounted below the holding portion 13 and extends forward.

The holding device 3 including two holding plates 31, two pivots 32, two elastic elements 33, and two caps 34. The two holding plates 31 are respectively mounted to the two sides of the holding portion 13. Each of the two holding plates 31 includes a holding plate body 311 for holding the forearm of the user. Each holding plate body 311 includes a side pivotal portion 312 received in one of the notches 131. Each side pivotal portion 312 includes an upper end having an insertion groove 313 that is non-circular in cross section and that is aligned with the pivotal hole 141 of one of the upper pivotal portions 14. Each side pivotal portion 312 further includes a lower end having a pivotal hole 314 receiving the axle 151 of one of the upper pivotal portions 15. The pivotal hole 314 of each side pivotal portion 312 includes an inner periphery having an upper end with a projection 315 abutting against the limiting member 153 to limit a minimum holding angle of the two holding plates 31.

Each of the two pivots 32 is received in the pivotal hole 141 of one of the upper pivotal portions 14. Each of the two pivots 32 includes a lower end having an insertion portion 321 that is non-circular in cross section and that is received in the insertion groove 313 of one of the two holding plates 31. Each of the two holding plates 31 is configured to pivot one of the two pivots 32 in the pivotal hole 141 of one of the upper pivotal portions 14. Each of the two pivots 32 includes an upper end having a coupling portion 322 with a slot 323. Each coupling portion 322 is cylindrical in cross section in this embodiment.

Each of the two elastic elements 33 is coupled to one of the two pivots 32 and the holding portion 13 of the supporting rod 1 and biases one of the two holding plates 31 to hold the forearm of the user. In this embodiment, each of the two elastic elements 33 is a coil spring having a coil portion 331 and first and second tangs 332 and 333. The coil portion 331 of each coil spring is mounted around the coupling portion 322 of one of the two pivots 32. The first tang 332 and the second tang 333 of each coil spring are respectively mounted to the slot 323 of one of the two pivots 32 and the insertion groove 142 of one of the upper pivotal portions 14. The two holding plates 31 are biased by the elastic forces of the elastic elements 33 to hold the forearm of the user, and the projections 315 abut against the limiting members 153. Furthermore, a spacing 316 between the front ends of the holding plate bodies 311 is smaller than a diameter of the forearm of the user.

Each of the two caps 34 covers a top end of the pivotal hole 141 of one of the upper pivotal portions 14. Each of the two caps 34 includes a lid 341 and a sidewall 342 extending downward. The sidewall 342 of each of the two caps 34 engages with the at least one engaging protrusion 143 to stably cover the pivotal hole 141 of one of the upper pivotal portions 14. Thus, the two elastic elements 33 and the two pivots 32 can be concealed to improve the assembly quality.

The two holding plates 31 of the holding device 3 according to the present invention provide a better holding force through bias of the two elastic elements 33. The two elastic elements made of metal are more durable, permitting a long term use without the risk of fatigue, which provides a more stable holding effect than conventional crutches.

Figure 5:
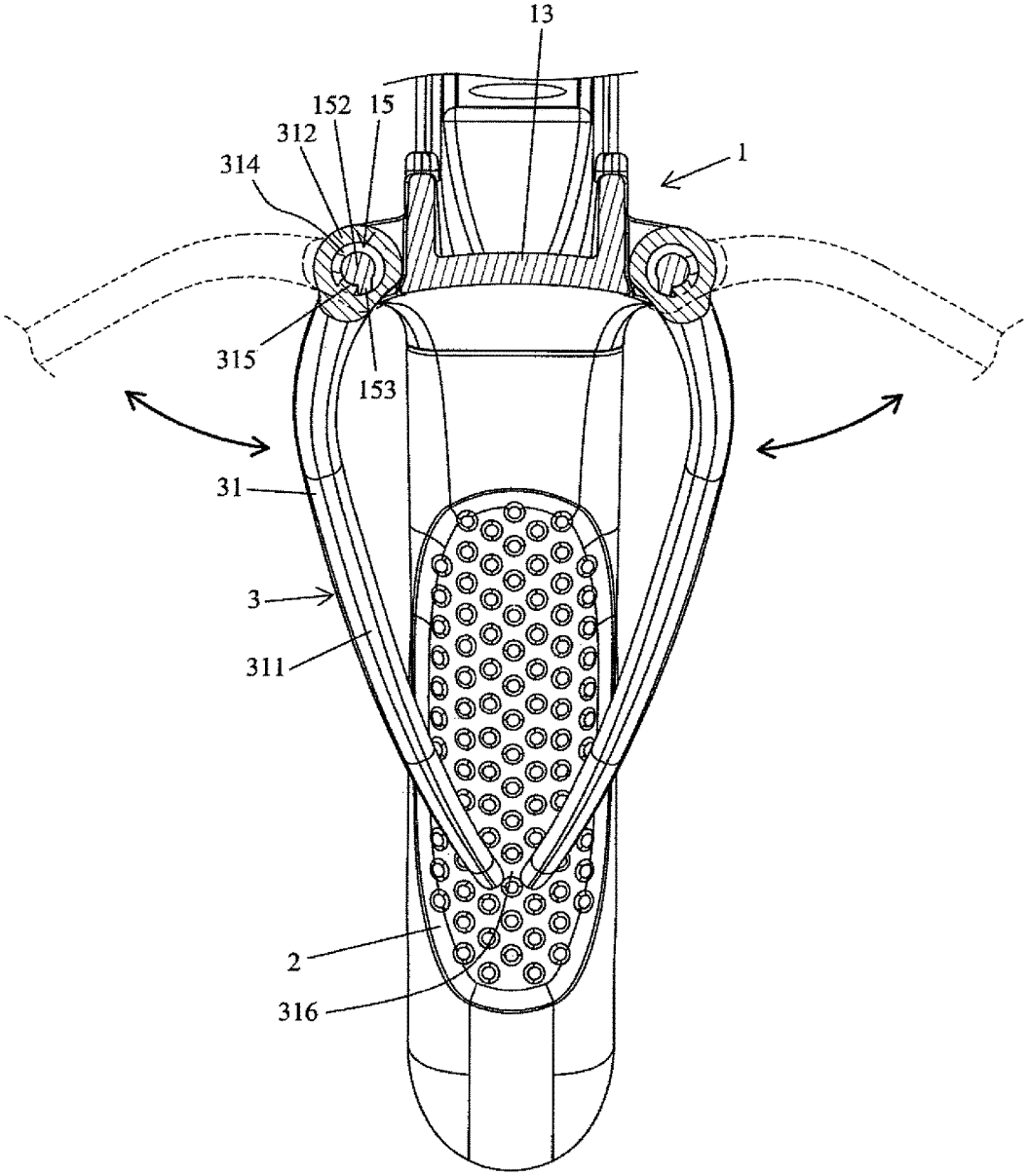
FIG. 5 is a cross sectional view taken along section line B-B of FIG. 3.
Figure 6:
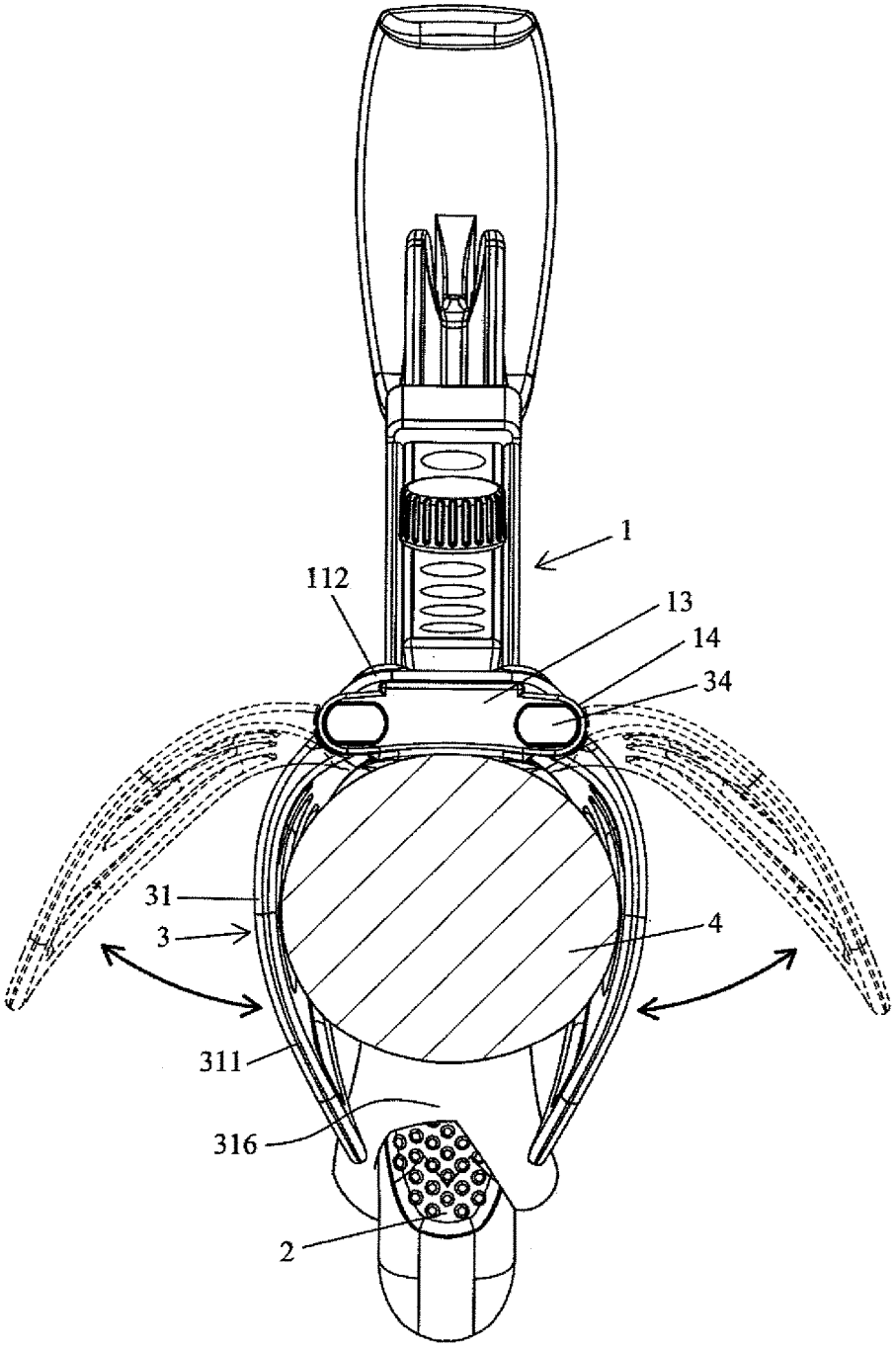
FIG. 6 is a diagrammatic cross sectional view illustrating holding of a forearm by two holding plates of the forearm crutch.

With reference to FIG. 5, the spacing 316 between the two holding plates 31 is assured by the projections 315 abutting against the limiting members 153. In use, the two holding plates 31 can be moved away from each other to permit the user to place his or her forearm 4 into the space between the two holding plates 31 (FIG. 6), providing convenient use.

With reference to FIGS. 7 and 8, the user can select an appropriate coupling hole 161 of the lower section 12, and the positioning knob 19 extends into the appropriate coupling hole 161 of the lower section 12 and the coupling hole 114 of the upper section 11 to fix the supporting rod 1 to a desired length. Furthermore, the two holding plates 31 provide a better holding force to hold the forearm 4 of the user, avoiding disengagement from the forearm crutch. Furthermore, when the supporting rod 1 is subject to a downward force, the bend section 18 can elastically deform. When the downward force is larger, the upper and lower abutting plates 183 and 184 abut against each other to avoid excessive deformation of the bend section 18 (which would significantly change the length of the forearm crutch) and to avoid breakage of the bend section 18, providing better supporting comfort and use safety.

In view of the foregoing, the forearm crutch according to the present invention is more stable, more reliable, and more convenient in holding the forearm 4 of the user than conventional forearm crutches.

Although specific embodiments have been illustrated and described, numerous modifications and variations are still possible without departing from the scope of the invention. The scope of the invention is limited by the accompanying claims.

The invention claimed is:

1. A forearm crutch comprising:

a supporting rod adapted to contact with ground, wherein the supporting rod includes an upper end having a holding portion;

a handle mounted below the holding portion and extending forward; and a holding device including two holding plates and two elastic elements, wherein the two holding plates are respectively mounted to two sides of the holding portion, wherein each of the two elastic elements is coupled between one of the two holding plates and the holding portion to provide the two holding plates with a holding force relative to the holding portion for holding a forearm of a user, wherein each of the two sides of the holding portion includes a notch, wherein each of the two sides of the holding portion further includes an upper pivotal portion protruding into a respective notch and a lower pivotal portion protruding into the respective notch, wherein each upper pivotal portion has a pivotal hole, wherein each lower pivotal portion includes an axle extending upward, wherein the holding device further includes two pivots, wherein each of the two holding plates includes a holding plate body for holding the forearm of the user, wherein each holding plate body includes a side pivotal portion received in one of the notches of the two sides of the holding portion, wherein each side pivotal portion includes an upper end having an insertion groove aligned with the pivotal hole of one of the upper pivotal portions, wherein each side pivotal portion further includes a lower end having a pivotal hole receiving the axle of one of the upper pivotal portions, wherein each holding plate body has a front end, wherein the front ends of the holding plate bodies have a spacing therebetween, wherein each of the two pivots is received in the pivotal hole of one of the upper pivotal portions, and wherein each of the two pivots includes a lower end having an insertion portion received in the insertion groove of one of the two holding plates, wherein each of the two holding plates is configured to pivot one of the two pivots in the pivotal hole of one of the upper pivotal portions, and wherein each of the two elastic elements is coupled to one of the two pivots and the holding portion of the supporting rod and biases one of the two holding plates to hold the forearm of the user.

2. The forearm crutch as claimed in claim 1, wherein each of the two elastic elements is made of metal.

3. The forearm crutch as claimed in claim 1, wherein the pivotal hole of each upper pivotal portion of the supporting rod includes an inner periphery having an insertion groove, wherein each of the two pivots includes an upper end having a coupling portion with a slot, wherein each of the two elastic elements is a coil spring having a coil portion and first and second tangs, wherein the coil portion of each coil spring is mounted around the coupling portion of one of the two pivots, and wherein the first tang and the second tang of each coil spring are respectively mounted to the slot of one of the two pivots and the insertion groove of one of the upper pivotal portions.

4. The forearm crutch as claimed in claim 1, wherein each of the lower pivotal portions of the supporting rod includes a limiting portion having a diameter smaller than the axle thereof, wherein each limiting portion has a limiting member on an outer periphery thereof, wherein the pivotal hole of the side pivotal portion of each holding plate receives the axle of one of the lower pivotal portions, wherein the pivotal hole of each side pivotal portal portion includes an inner periphery having an upper end with a projection abutting against the limiting member to limit a minimum holding angle of the two holding plates.

5. The forearm crutch as claimed in claim 1, wherein the holding device further includes two caps, and wherein each of the two caps covers the pivotal hole of one of the upper pivotal portions.

6. The forearm crutch as claimed in claim 5, wherein the pivotal hole of each of the upper pivotal portions includes an inner periphery having an engaging protrusion, wherein each of the two caps includes a lid and a sidewall extending downward, and wherein the sidewall of each of the two caps engages with the engaging protrusion to cover the pivotal hole of one of the upper pivotal portions.

7. The forearm crutch as claimed in claim 1, wherein the supporting rod includes an upper section, a lower section, and a positioning knob, wherein the upper section and the lower section are coupled by the positioning knob, wherein the holding portion is disposed on the upper section, and wherein the lower section includes a lower end having a supporting portion.

8. A forearm crutch comprising:

a supporting rod adapted to contact with ground, wherein the supporting rod includes an upper end having a holding portion;

a handle mounted below the holding portion and extending forward; and a holding device including two holding plates and two elastic elements, wherein the two holding plates are respectively mounted to two sides of the holding portion, wherein each of the two elastic elements is coupled between one of the two holding plates and the holding portion to provide the two holding plates with a holding force relative to the holding portion for holding a forearm of a user, wherein the supporting rod includes an upper section, a lower section, and a positioning knob, wherein the upper section and the lower section are coupled by the positioning knob, wherein the holding portion is disposed on the upper section, wherein the lower section includes a lower end having a supporting portion, wherein a lower end of the upper section includes a coupling groove extending in a vertical direction and a lateral wall having a coupling hole in communication with the coupling groove, wherein the lower section includes an upper end having an insertion section with a plurality of coupling holes spaced from each other in a vertical direction, wherein the insertion section is inserted into the coupling groove, and wherein the positioning knob extends through the coupling hole of the upper section and one of the plurality of coupling holes of the lower section to fix a length of the supporting rod.

9. The forearm crutch as claimed in claim 8, wherein the supporting portion includes a rectilinear section connected to a lower end of the insertion section, wherein the supporting portion further includes a lower end with a bend section, wherein the bend section is arcuate and includes a bottom, wherein the bend section further includes an upper inner face and a lower inner face, wherein an upper abutting plate extends outward from the upper inner face, and wherein a lower abutting plate extends outward from the lower inner face and is spaced from the upper abutting plate to provide a buffering space for the bend section when compressed.

* * * * *